US008459901B2

(12) United States Patent
van Nood et al.

(10) Patent No.: US 8,459,901 B2
(45) Date of Patent: Jun. 11, 2013

(54) JACKING SYSTEM

(75) Inventors: Cornelis Pieter Aartdrianus van Nood, Delft (NL); Johan Albert Commandeur, Zwijndrecht (NL); Johannes Andries Hofman, Utrecht (NL)

(73) Assignee: GustoMSC Resources B.V., Schiedam (NL)

( * ) Notice: Subject to any disclaimer, the term of this patent is extended or adjusted under 35 U.S.C. 154(b) by 331 days.

(21) Appl. No.: 12/671,533

(22) PCT Filed: Jul. 10, 2008

(86) PCT No.: PCT/NL2008/050466
§ 371 (c)(1),
(2), (4) Date: Feb. 1, 2010

(87) PCT Pub. No.: WO2009/017399
PCT Pub. Date: Feb. 5, 2009

(65) Prior Publication Data

US 2011/0211915 A1 Sep. 1, 2011

(30) Foreign Application Priority Data

Jul. 30, 2007 (EP) ..... 07113425

(51) Int. Cl.
*E02B 17/08* (2006.01)

(52) U.S. Cl.
USPC ..... 405/198; 405/196; 254/105

(58) Field of Classification Search
USPC ..... 405/196, 198, 199, 203, 221
See application file for complete search history.

(56) References Cited

U.S. PATENT DOCUMENTS

| | | | | |
|---|---|---|---|---|
| 2,932,486 | A | 4/1960 | Suderow | |
| 3,056,585 | A | 10/1962 | Smulders | |
| 3,259,368 | A | 7/1966 | Warnke | |
| 3,372,907 | A * | 3/1968 | Hage et al. | 254/110 |
| 3,804,369 | A | 4/1974 | Sutton | |
| 4,007,914 | A | 2/1977 | Sutton | |

(Continued)

FOREIGN PATENT DOCUMENTS

| | | |
|---|---|---|
| FR | 2 235 602 | 1/1975 |
| GB | 2 004 246 | 3/1979 |
| GB | 2 004 247 | 3/1979 |

OTHER PUBLICATIONS

International Search Report dated Aug. 28, 2008, from corresponding PCT application.

*Primary Examiner* — John Kreck
*Assistant Examiner* — Benjamin Fiorello
(74) *Attorney, Agent, or Firm* — Young & Thompson

(57) ABSTRACT

A jacking system for jacking a structure, includes a leg having a longitudinal axis and including first engagement parts along the leg, and a guiding frame displaceable along the leg. The guiding frame includes at least a first, second, third and fourth actuator, the actuators each having a first and second actuator part which in operation can displace with respect to one another along the leg, the first actuator part of the actuators coupled to the guiding frame, the second actuator parts of the actuators each coupled to first engagement parts for engaging and disengaging the first engagement parts of the leg for providing abutment in the longitudinal direction of the leg, the second actuator parts of the actuators displaceable along the leg past one another, and the actuators being arranged in pairs opposite one another with respect to a longitudinal plane of the leg.

15 Claims, 3 Drawing Sheets

U.S. PATENT DOCUMENTS 4,199,276 A * 4/1980 Molsberger ..... 405/198
4,411,408 A 10/1983 Radovan et al.
4,657,438 A * 4/1987 Gillis ..... 405/198
2004/0009043 A1* 1/2004 Sehl ..... 405/218

* cited by examiner

JACKING SYSTEM

BACKGROUND

The present invention relates to a jacking system for jacking a structure, for instance offshore platforms or vessels, out of the water, and a method for jacking using this system.

Such a jacking system is for instance disclosed in U.S. Pat. No. 3,804,369. This jacking system has pairs of hydraulic cylinders which are mutually coupled using wire cables.

Another such jacking system is disclosed in U.S. Pat. No. 4,007,914. This system has three mutually fixed frame parts. One end of a hydraulic cylinder is fixed to one frame part, one end of another hydraulic cylinder is fixed to a next frame. The other ends of the hydraulic cylinders are coupled.

Yet another such jacking system is disclosed in U.S. Pat. No. 4,411,408. This jacking system has a leg which has several "chords" each having two hydraulic cylinders at opposite sides of a chord. Both ends of the hydraulic cylinders have a retractable pin which can be extended into passages in a chord. Both cylinders displace in a synchronised fashion.

GB-2.004.246 discloses a jacking system with square legs with holes and a frame which is attached to a platform which may have two yokes at two opposite sides of a leg and which have pins which are insertable in the holes of the legs. The frame has locking pins at the same sides of the actuators. These limit the stroke of the yokes.

GB-2.004.247 discloses a jacking system with square legs with holes and a frame which is attached to a platform which has two yokes at opposite sides of a leg and which have pins insertable in these holes. The yokes can pass one another and thus together provides a fast leg handling. Handling of high loads may be a problem, as well is simultaneously handling several legs on one platform.

FR-A-2.235.602 discloses a platform provided with legs which can be lowered by filling the legs with ballast, and raised by removing ballast. When the legs rest on the bottom of the sea, the platform can be raised via a jacking system. The legs have reservoirs for storing oil, for instance, and are made of concrete. Each leg has four actuators. The actuators are positioned within the platform, thus limiting their stroke to the thickness of a platform. All four actuators have the same stroke, and can all only cover one pitch distance. Furthermore, it has locking pins at fixed positions.

U.S. Pat. No. 2,932,486 discloses a jacking system for jacking a platform. It has legs provided with rails with holed. Furthermore, it has double acting hydraulic cylinders with locking pins at one end of the cylinders and locking pins at the opposite end of the cylinders on a frame attached to the platform. It uses two or three actuators for each leg. Furthermore, the actuators have identical maximum working strokes.

U.S. Pat. No. 3,056,585 discloses a pontoon with legs which can be raised and lowered. Each leg is square and has at each corner a first hydraulic cylinder which can extend in a first direction and a second hydraulic cylinder which can extend in the opposite direction. The ends of two adjacent first cylinders are coupled via a beam, and the second cylinders that in line are also coupled via a beam. Those beams engage in recesses of rails provided at the four corners of a leg. Thus, there are in fact four actuators, with two actuator at the same side of a leg, and in line. The two actuators move in opposite directions. The entire actuator system thus extend along a considerable length of a leg.

All these systems thus have several disadvantages regarding jacking speed, holding efficiency, compactness or complexity. Some systems need legs which are longer than strictly needed. Others need relatively high frames or lack stability. There is, therefore, room for improvement.

SUMMARY OF THE INVENTION

An object of the current invention is to improve the jacking systems and/or to provide an alternative jacking system.

According to a first aspect of the invention at least one of these objectives is realized with a jacking system for jacking a structure, in particular for jacking offshore platforms or vessels out of the water, said jacking system comprising a leg having a longitudinal axis and comprising first engagement parts along said leg, and a guiding frame displaceable along said leg, said guiding frame comprising at least a first, second, third and fourth actuator, said actuators each having a first and second actuator part which in operation can displace with respect to one another along said leg, said first actuator part of said actuators coupled to said guiding frame, said second actuator parts of said actuators each coupled to first engagement parts for engaging and disengaging said first engagement parts of said leg for providing abutment in the longitudinal direction of said leg, said second actuator parts of said actuators displaceable along said leg past one another, and said actuators being arranged in pairs opposite one another with respect to a longitudinal plane of said leg.

This provides the possibility of reducing the length of the legs of a jacking system. Furthermore, as the ends of the actuators can displace past one another, a construction can be raised or lowered faster.

As the actuators can pass one another, a jacking system is provided which can operate almost continuously.

The proposed system furthermore allows the jacking system to be build easily and cheap.

Furthermore, the legs will be loaded symmetrically. It also allows more modes of operation, making it possible of more carefully designing the actuators.

When the jacking system uses hydraulic cylinders as actuators, these cylinders at various stages have to return to their retracted position. This process is called 'recycling'. This expression will be used in this description, but does not necessarily refer to hydraulic systems only. In most embodiments, the hydraulic cylinders will be double stroke cylinders.

In this text, both vessel and platform are used. It should be clear that the jacking system can be used in particular for offshore platforms and temporary platforms, for instance the vessels and ships described further on.

The jacking system of the current invention is also used in vessels which install offshore constructions like windmills in coastal waters or in open sea, and in other constructions which need to be raised and/or lowered. This requires operational speed, and also the capability of handling large loads and also loads which have large fluctuations.

The jacking system of the current invention is able to jack an offshore platform out of the water by positioning one or more legs on the sea floor and lift the platform out of the water. In this process of leg handling, the following phases can be distinguished which all have their specific requirements on the jacking system:

Leg lowering phase;
jacking phase;
platform holding phase;
platform lowering phase;
leg lifting phase.

When a platform or vessel arrives at its operational position, the legs are lowered in the leg lowering phase. In this phase, the loads on the legs are minimal. The legs are lowered until they reach the sea floor. During this phase, lowering needs to be done in a controlled manner. At the end of this phase, usually the length of each of the legs below the vessel will be different due to variations is the seafloor.

When the legs rest on the bottom, the jacking phase can start. At this stage, the vessel or platform will be lifted out of the water and will eventually completely rest on the legs. It may also be possible to lift the platform only partially and thus use the legs as a stabilising means. Thus, in this mode the platform only partially rests on the legs. In is evident that during this jacking phase, the vessel or platform should be kept as horizontal as possible.

After the jacking phase, the actual work of the vessel can start. The vessel rests on the legs and provides a stable working platform. When conditions become severe, for instance during storms, or when the seafloor is or becomes unstable, a platform holding phase can be identified.

After the work is done, the platform lowering phase starts. During this phase, the vessel will be lowered until the does not rest on the legs any more and floats. Again, during lowering the vessel should remain as much as possible in a horizontal position. During this phase, the weight of the vessel should be controlled.

Next, the leg lifting phase starts. During this phase, the legs are lifted and fully retrieved, normally above the bottom of the platform of the vessel, in such a way that for instance the vessel is ready to sail away.

Between the already-mentioned phases, there are several modes of operation/phases which can be used during of in between those phases.

1) Touchdown/transition phase between leg lowering and platform lifting. Normally leg lowering is stopped when the legs are just above the seabed. Then the touchdown is done with one long stroke (2S), immediately followed by a number of jacking cycles.

2) Pre-loading. In order to stabilize the legs on the sea floor sufficiently to survive the design environmental conditions the legs are statically pre-loaded to the maximum expected leg load during those environmental conditions. That load will be held for a while to allow settling of the sea floor. This is called pre-loading. It requires more than the jacking force, so all actuators need to be engaged to the leg. In this respect, providing a platform with at least four legs may have an advantage. In such a case, it is possible to pre-load for instance two legs cross-wise, then two other legs cross-wise until the entire platform is sufficiently stabilized.

3) Leg pulling, between platform lowering and leg lifting. A leg can get stuck in the sea bed. To retrieve the leg significant pulling force may be required. This can be done with 4 actuators engaged to the leg and operating simultaneously.

Therefore, it is clear that providing four actuators provides additional advantages and possible modes of operation of the jacking system.

Various embodiments of the jacking system will now be discussed.

In an embodiment, the first and third actuators and the second and fourth actuators are opposite actuators. Thus loads can be balanced and pairs can operate independently.

In an embodiment, the actuators are positioned round the leg.

In an embodiment, the first and third actuators and the second and fourth actuators are arranged at opposite sides of a leg.

This all allows balancing of loads and independent operation of actuators.

In an embodiment, said actuators have a working stroke which is defined as the distance the second actuator part can travel along a leg, wherein the working stroke of one pair of actuators differs from the working stroke of another pair of actuators. Thus, it is possible to stabilise and lower from uneven seafloors, for instance In a further embodiment, the first engagement parts are provided at a pitch S along a leg, and the working stroke differs at least an amount S.

In an embodiment of the jacking system said leg further comprises second engagement parts along said leg, and said second actuator parts are further coupled to second engagement parts engaging the respective second engagement parts of said leg for providing abutment in the transverse direction of said leg.

In an embodiment of the jacking system, said second engagement parts of said leg comprise at least one rail along said leg, and said second engagement parts of said actuators abut said rail in a direction having a radial component and in a direction having a tangential component and is slideable along said rail.

In an embodiment of the jacking system, said leg is provided with a rail for each of said actuators.

In an embodiment of the jacking system, each of said actuators comprises two hydraulic cylinders having one end coupled to said guiding frame and the other end coupled to said second actuator part and each of said first engagement parts comprise a retractable pin is moveable in a direction transverse to said leg from a first position in which it is free from said leg into a second position in which it engages one of said first engagement parts of said leg for providing abutment in the longitudinal direction.

In an embodiment of the jacking system, the first engagement parts of said leg are provided at a regular mutual distance along the leg, and said first and second actuator parts are displaceable along a minimum distance of the distance of the engagement parts.

In an embodiment of the jacking system, at least one actuator has first and second actuator parts which are displaceable along a minimum distance of at least two times the mutual distance of the engagement parts.

The invention further relates to a method for jacking a structure, in particular offshore platforms or vessels, out of the water, said structure comprising a platform and at least one jacking system described above, wherein said actuators are activated one after the other.

The invention further relates to a leg for a jacking system according to the invention.

The invention further relates to a guiding frame for a jacking system according to the invention.

The invention further relates to a jacking system or platform comprising one or more of the characterising features described in the description and/or shown in the attached drawings.

The invention further relates to a method comprising one or more of the characterising features described in the description and/or shown in the attached drawings.

The various aspects discussed in this patent can be combined in order to provide additional advantages.

DESCRIPTION OF THE DRAWINGS

The invention will be further elucidated referring to an preferred embodiment shown in the drawing wherein shown in.

DETAILED DESCRIPTION OF EMBODIMENTS

Figure 1:
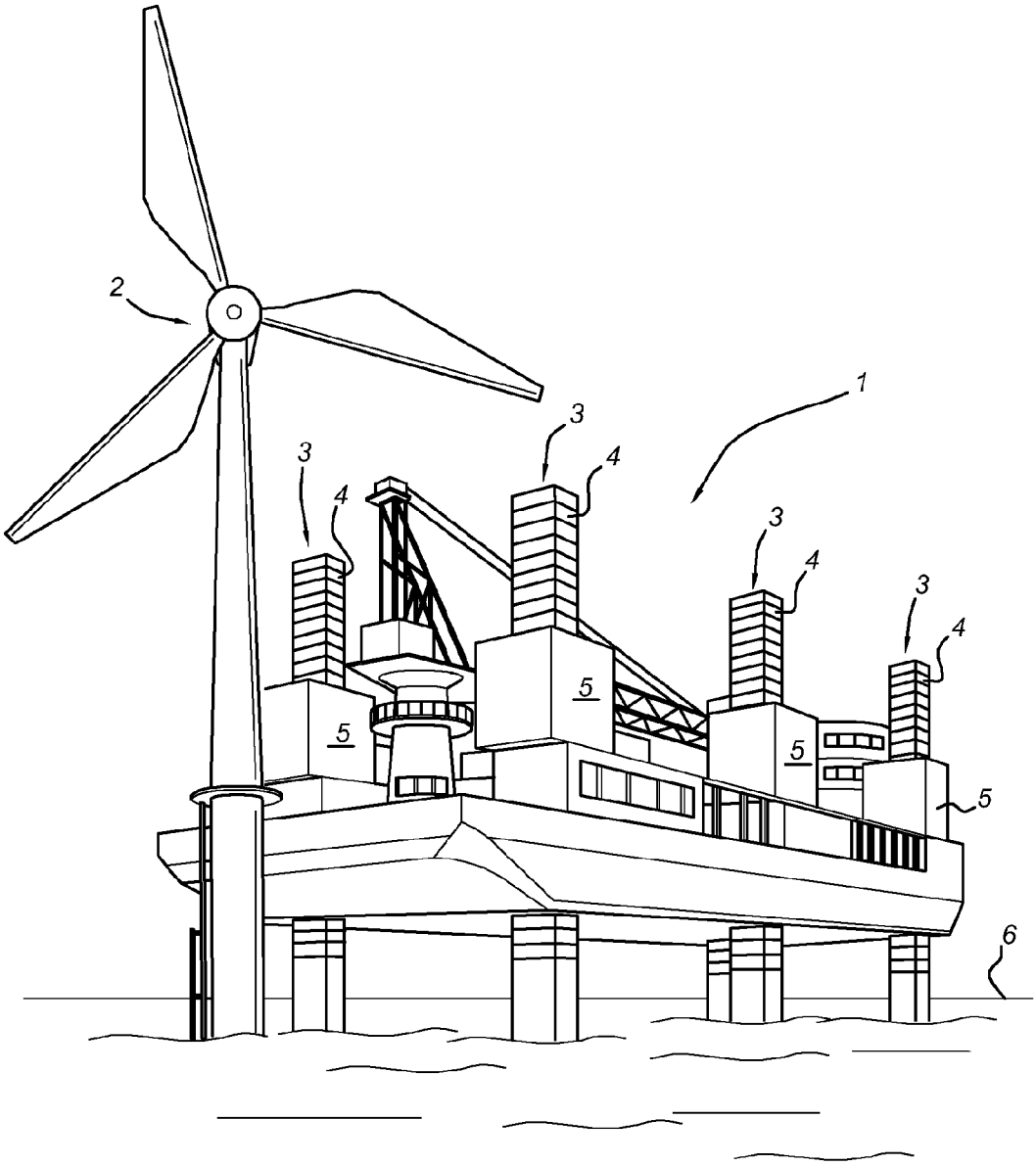
FIG. 1 a vessel having several jacking systems according to the invention.

In FIG. 1 a vessel 1 is shown for placing offshore constructions such as a windmill 2. The vessel is provided with a number of jacking systems 3 for jacking or lifting the vessel out of the water, i.e. above the surface of the water. To that end, the legs 4 rest on the bottom of the sea.

For installing for instance a windmill, the vessel 1 has the windmill 2 on board and sails to a location where the windmill has to be placed. At that location, the legs 4 of the vessel are lowered until they rest on the seafloor. This stage is called leg handling phase. Then, the vessel is lifted out of the water using the guiding frames 5 which engage the legs 4. This stage is called the jacking phase. After the vessel is lifted out of the water, the windmill is erected and placed on the seafloor. After installation of the windmill, the vessel is lowered again, and subsequently the legs 4 are raised from the seafloor using the guiding frames 5, and the vessel sails away. It is clear that the speed at which the legs can be lowered, the speed at which vessel can be jacked out of the water, lowered back in the water and the speed at which the legs can be retrieved is economically important. One of the complicating factors is that the seafloor generally is very uneven.

Figure 2:
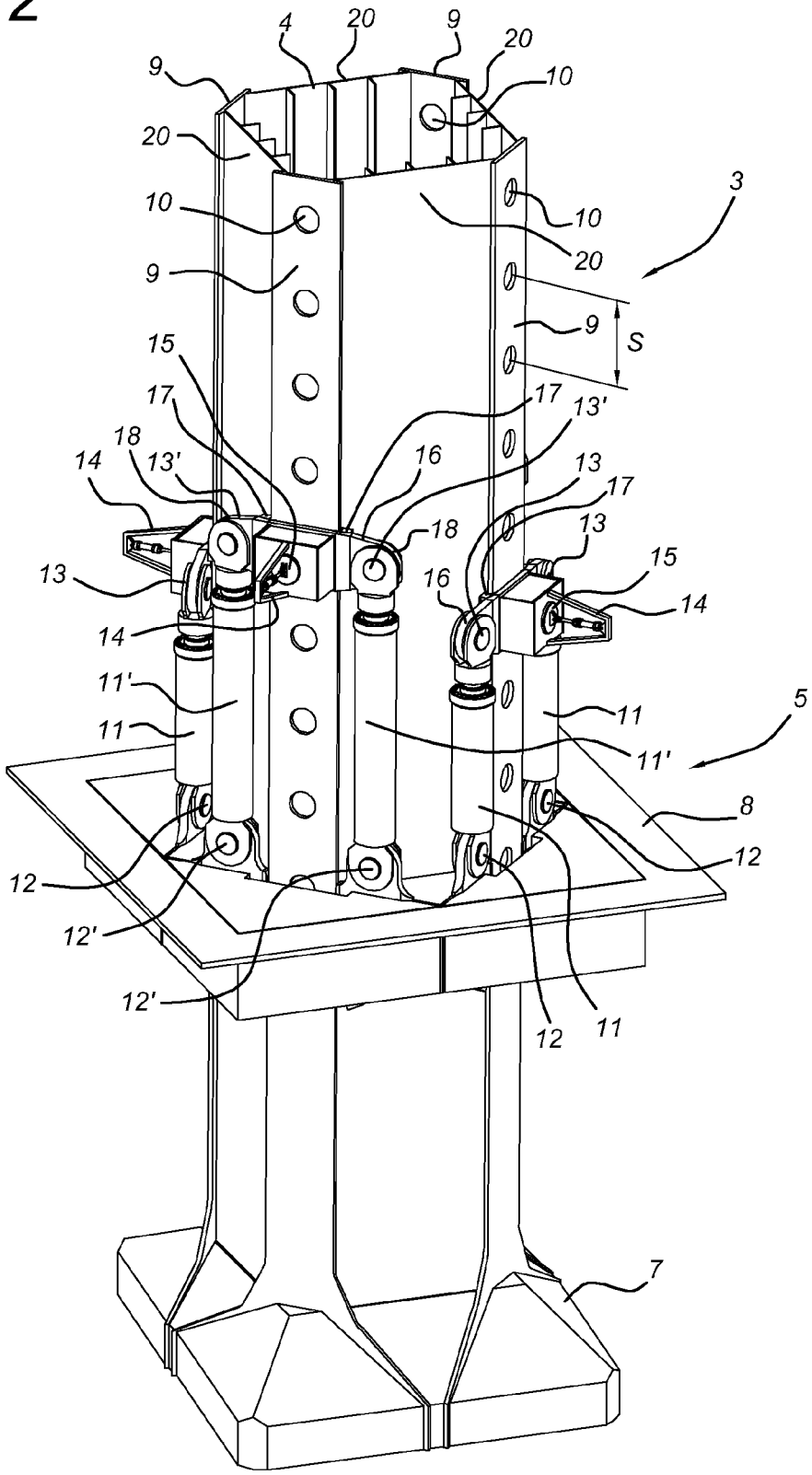
FIG. 2 an embodiment of a jacking system according to the current invention in side view.

FIG. 2 shows a jacking system 3 of the current invention in perspective view. A vessel or other offshore construction may comprise one or several of such jacking systems 3. The jacking system 3 comprises a leg 4 and jacking device 5. Leg 4 has a foot 7 for resting on a seafloor.

The leg 4 in this embodiment has a substantially square cross section with a rail 9 at each corner with through holes 10 at a regular mutual distance along the leg. The leg 4 can also be called octagonal in cross section having the rails as some of its sides. The leg 4 may also be triangular in cross section having for instance three rails, be round of elliptical in cross section, or may have another cross section. The legs shown with four rails, however, have the advantage of several actuators described below.

In the embodiment shown, the leg can have a connecting bar, beam or plate substantially parallel to the normal of the rails 9, in order to provide rigidity and strength against forces working substantially normal to the rails 9. In an embodiment, several plates are provided which connect all the rails 9 and in most cases also the plates 20 connecting the rails 9.

Jacking device 5 has a frame 8 which is coupled to the vessel. Jacking device 5 further has actuators 11, 11', in this embodiment, each comprising two hydraulic cylinders. In particular, these hydraulic cylinders are double acting cylinders, which again allows an increase in operational speed. The actuators can also be of an electrically driven type, for instance comprising one or more servomotors. These types of actuators are not very common in the offshore field, however.

Actuators 11, 11' have a first end 12, 12' attached to frame 8. The actuators extend along the leg 4 and have an opposite, second end 13, 13' which in operation displaces with respect to the first end 12, 12'. The second end 13, 13' has an engagement part 14, 15 which can engage and disengage the leg 4.

In this embodiment, the actuators 11, 11' have two hydraulic cylinders which at one end 12, 12' are attached to frame 8. The opposite ends 13, 13' of both hydraulic cylinders are attached to a guide 16 which can slide over rail 9. The guide has guide members 17 which slidably engage rail 9. In this embodiment shown, the rail 9 has two opposite rims, and two opposite guide members 17 grab around said rims.

The engagement part 14, 15 has a pin 15 which can slide in and out the holes 10 of rail 9. These holes are provided at a pitch S. The pin 15 is operated by an actuator 14, here a hydraulic cylinder 14. These pins provide a positive engagement to the rails 9.

Figure 3:
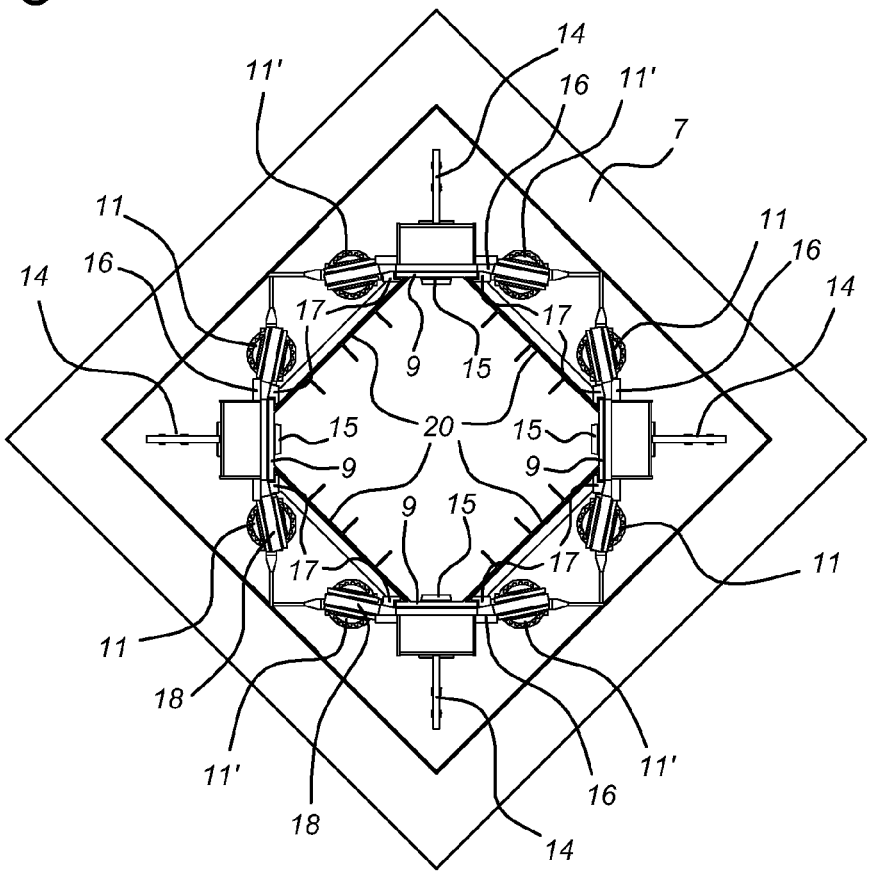
FIG. 3 the embodiment of FIG. 2 in top view.

FIG. 3 shows a top view of the jacking system 3 of FIG. 4. The hydraulic cylinders 11, 11' are attached at their upper ends 13, 13' to the guide 16 which can slide over rail 9. In the drawing it is indicated that the attachment parts 18 of guide 16 are at a small angle and not at a straight line. In that way, the forces of the hydraulic cylinder put a minimal strain to the rail 9 and to the leg.

In this embodiment, the pitch of the holes 10 is S. The stroke of the short actuators 11 corresponds to this pitch S, and the stroke of the long actuators 11' corresponds to 2·S. The actuators 11 and 11' can operate independently, thus allowing an even faster handling of the legs.

During the leg lowering phase, the short actuators only serve as locking means via their pins 15. The lowering phase will usually start with all the actuators 11, 11' of all the legs fully retracted. During the lowering phase, the following cycle will be repeated:

- The pins 15 of the long actuators 11' are retracted from their holes 10;
- The long actuators 11' are fully extended over a length 2S;
- The pins 15 of the long actuators 11' are inserted into corresponding holes 10;
- the pins 15 of the short actuators 11 are retracted from holes 10;
- the long actuators 11' are retracted, thus lowering the legs. During this lowering by retraction of the long actuators, the pins 15 of the long actuators 11' remain in corresponding holes 10;
- when the long actuators 11' are completely lowered, the pins 15 of the short actuators 11 are inserted in corresponding holes 10.

The cycle starts again until the feet 7 of legs 4 rest on the seafloor. Usually, when all the legs rest on the seafloor at the end of the last cycle, this will not mean that a hole 10 is at the position of a pin 15 of the short actuator 11. Thus, each of the short actuators of all the legs will be extended between a length O-S until their pins 15 can be inserted into a hole 10.

An even faster way of completing this lowering phase is a procedure in which in each cycle one of the long actuators 11' is recycled with its pin 15 retracted form a hole 10 while the other long actuator 11' is lowered. This is possible as one end of both actuators is not mutually coupled. The short actuators 11 are not used in this case.

After the lowering phase, the jacking phase starts. At the start of this stage, all the legs may have a different length extending below the vessel due to the irregular surface of the seafloor. This difference in length between legs will usually not be an integer multitude of pitch S, but will often be a multitude of pitch S and a fraction of this pitch S. The short actuators 11 are set to such a length that they bridge the fraction of a pitch difference between legs. Then, the short actuators 11 are fixed at those lengths that the vessel is in horizontal position, and will remain at those lengths during jacking. The pins 15 of the short actuators will be inserted in corresponding holes 10 for locking the legs. In that way, the short actuators 11 thus become an adjustable locking system for the legs, while the long actuators 11' become a leg moving system.

Then following jacking cycle will be performed:

- The pins 15 from the long actuators 11' are retracted;
- the long actuators 11' for all the legs will simultaneously extend from a starting position, which will be between O-S extended, to an extended position which will be between 0 and 2S, i.e. a position where their pins 15 are in position with holes 10;

Subsequently, the pins 15 of the long actuators 11' will be inserted in the holes 10;

the pins 15 of the short actuators 11 will be retracted from their holes 10;

the long actuators 11' of all the legs will be actuated back to their starting positions simultaneously.

Finally, the pins 15 of the short actuators will be inserted in corresponding holes 10 for locking the legs again.

This cycle will be repeated. Thus, the vessel or platform will be lifted an amount S during each cycle and will remain horizontal. The adjustable position of the short actuators 11 makes recycling of the long actuators 11' possible for all legs simultaneously, improving the overall jacking speed of the platform.

Usually, the two long actuators 11' of this embodiment will both be needed for jacking as this requires lifting a large weight, and only one long actuator 11' will be needed during the other phases, thus allowing these other phases to proceed at a larger speed: one long actuator 11' can be extended while the other one can be recycled.

When the platform arrives at its jacked position, usually lifted out of the water, it can start its activities like positioning windmill poles or masts. During these operations, the legs may encounter high vertical loads, in some cases even higher than during jacking of the platform. To transfer these loads the pins 15 of all the actuators 11 and 11' will engage to the legs 4, resulting in a holding capacity that is double the jacking capacity of the system.

After completion of its work, the platform will be lowered into the water during the platform lowering phase. At the start of this phase, usually the short actuators will be extended to a length between O-S, and their pins 15 will be inserted into corresponding holes 10. Again, just like the jacking phase, the platform should remain horizontal.

For the platform lowering phase, the following cycle is repeated:

The pins 15 of the short actuators 11 will unlock from the holes 10;

the long actuators 11' of all the legs will simultaneously extend, lowering the platform, until extended to a length of between 0 and 2S;

the pins 15 of short actuators 11 will lock the legs;

Next, the pins 15 of the long actuators 11' will unlock from their holes 10, and the long actuators 11' will be retracted to their starting positions between 0 and 2S.

Next, the pins 15 of the long actuators 11' will lock into holes 10.

This cycle is repeated until the platform floats in the water again. During each cycle, the platform can be lowered a distance S. After this phase, the leg lifting phase starts.

In the leg lifting phase, the legs are fully lifted to enable the vessel to sail away. To that end, the following cycle can be used. At this stage, the legs still extend below the vessel at different lengths, but the vessel already floats. All the legs will now be raised to such extend that a hole 10 corresponds to the full retracted position of the actuators 11, 11'. This phase will usually start with all the actuators 11, 11' in fully retracted position. During the leg lifting phase, the long actuators 11' can use their full extension length of 2S. The pins 15 of the short actuator 11 will unlock, and the long actuators 11' will fully extend, taking the legs up with them. The short actuators are at the same time fully retracted and when the long actuators 11' are fully extended, the pins 15 of the short actuators 11 which are now positioned at the location of a hole 10 are inserted into a hole to lock the leg. Subsequently, the pins 15 of the long actuators 11' are fully retracted from the holes 10, and the long actuators 11' will be fully retracted to their positions 0. The pins 15 of the long actuators 11' are now inserted in the holes 10. Thus, the following cycle is repeated:

the pins 15 of the short actuators 11 are retracted from the holes, the long actuators 11' are extended to their full length 2S, lifting the legs an amount 2S;

the pins 15 of the short actuators 11 will lock the legs.

the pins 15 of the long actuators 11' retract, the long actuators 11' are fully retracted and the pins 15 of the long actuators 11' will be inserted into the holes 10.

This cycle will end when the legs are fully retracted. Thus, for some legs this will need more cycles than for other legs. During each cycle, a leg will be lifted an amount 2S.

The jacking system may also be designed in such a way that one actuator is powerful enough to lift a leg on its own. In that case, the leg lifting phase can proceed even faster when the two long actuators 11' of one leg are used one after the other in stead of simultaneously. In that case one long actuators 11' is lifting the leg while the other long actuators 11' is being recycled.

It will also be clear that the above description and drawings are included to illustrate some embodiments of the invention, and not to limit the scope of protection. Starting from this disclosure, many more embodiments will be evident to a skilled person which are within the scope of protection and the essence of this invention and which are obvious combinations of prior art techniques and the disclosure of this patent.

The invention claimed is:

1. A jacking system for jacking a structure, for jacking offshore platforms or vessels out of the water, said jacking system comprising:

a leg having a longitudinal axis and comprising first and second engagement parts along said leg, said second engagement parts of said leg comprising at least one rail along said leg; and a guiding frame displaceable along said leg, said guiding frame comprising at least a first, second, third and fourth actuator, said actuators each having a first and second actuator part which in operation are displaceable with respect to one another along said leg, said first actuator part of said actuators coupled to said guiding frame, said second actuator parts of said actuators each coupled to a guide slidable over said rail and to first engagement parts for engaging and disengaging said first engagement parts of said leg for providing abutment in the longitudinal direction of said leg, said second actuator parts of said actuators displaceable along said leg past one another, and said actuators being arranged in pairs opposite one another with respect to a longitudinal plane of said leg, wherein, said second actuator parts are further coupled to further engagement parts for engaging the respective second engagement parts of said leg to provide abutment in the transverse direction of said leg, and said further engagement parts coupled to said actuators abut said rail in a direction having a radial component and in a direction having a tangential component and are slideable along said rail.

2. The jacking system according to claim 1, wherein the actuators are positioned round the leg.

3. The jacking system according to claim 2, wherein the first and third actuators and the second and fourth actuators are arranged at opposite sides of a leg.

4. The jacking system according to claim 3, wherein said actuators have a working stroke which is defined as the distance the second actuator part can travel along a leg, wherein the working stroke of one pair of actuators differs from the working stroke of another pair of actuators.

5. The jacking system according to claim 2, wherein said actuators have a working stroke which is defined as the distance the second actuator part can travel along a leg, wherein the working stroke of one pair of actuators differs from the working stroke of another pair of actuators.

6. The jacking system according to claim 1, wherein said actuators have a working stroke which is defined as the distance the second actuator part can travel along a leg, wherein the working stroke of one pair of actuators differs from the working stroke of another pair of actuators.

7. The jacking system according to claim 6, wherein the first engagement parts are provided at a pitch S along a leg, and the working stroke differs at least an amount S.

8. The jacking system according to claim 1, wherein said leg is provided with a rail for each of said actuators.

9. The jacking system according to claim 1, wherein each of said actuators comprises two hydraulic cylinders having one end coupled to said guiding frame and the other end coupled to said second actuator part and each of said first engagement parts comprise a retractable pin which is moveable in a direction transverse to said leg from a first position in which it is free from said leg into a second position in which it engages one of said first engagement parts of said leg for providing abutment in the longitudinal direction.

10. The jacking system according to claim 1, wherein the first engagement parts of said leg are provided at a regular mutual distance along the leg with a pitch S, and said first and second actuator parts are displaceable along a minimum distance of the mutual distance or pitch S of the engagement parts.

11. The jacking system of claim 10, wherein at least one pair of actuators has first and second actuator parts which are displaceable along a minimum distance of at least two times the pitch S of the engagement parts.

12. The jacking system according to claim 1, wherein said leg has an octagonal cross section with pairs of actuators at opposite sides, with actuators at each second side, at every other side.

13. The jacking system according to claim 1, wherein each of said actuators comprises two hydraulic cylinders adjacently connected side by side and to said guide slidable over said rail.

14. A method for jacking a structure, offshore platforms or vessels, out of the water, said structure comprising a platform and at least four jacking systems according to claim 1, wherein said actuators are activated at least in pairs.

15. A working platform, being an offshore platform or vessel, comprising at least four jacking systems according to claim 1.

* * * * *